US005601270A

United States Patent [19]

Chen

[11] Patent Number: 5,601,270

[45] Date of Patent: Feb. 11, 1997

[54] PAPER HOLDER ON WHICH A SHEET OF PAPER CAN BE SUPPORTED AT DIFFERENT INCLINATIONS

[76] Inventor: Cheng-Sung Chen, No. 380, Chung-Hua Rd., Tou-Liu City, Yun-Lin Hsien, Taiwan

[21] Appl. No.: 543,857

[22] Filed: Oct. 12, 1995

[51] Int. Cl.[6] ..... B65D 85/62

[52] U.S. Cl. ..... 248/454; 248/460; 248/291.1; 403/117

[58] Field of Search ..... 248/454, 441.1, 248/460, 291.1, 346.06, 457; 403/117, 116, 113, 112, 161; 40/745, 761, 341

[56] References Cited

U.S. PATENT DOCUMENTS

| | | | |
|---|---|---|---|
| 1,135,751 | 4/1915 | Balaban | 248/454 X |
| 2,140,176 | 12/1938 | Unger | 248/441.1 |
| 4,917,343 | 4/1990 | Wainscott | 248/454 X |
| 5,142,490 | 10/1992 | Deutsch | 248/457 X |
| 5,341,929 | 8/1994 | Stefancin, Jr. | 248/454 X |
| 5,487,521 | 1/1996 | Callahan | 248/441.1 |

*Primary Examiner*—Ramon O. Ramirez
*Assistant Examiner*—Brian J. Hamilla
*Attorney, Agent, or Firm*—Foley & Lardner

[57] ABSTRACT

A paper holder includes a generally rectangular holder plate, a clip member mounted on the holder plate and adapted to clamp a sheet of paper which lies on a front side surface of the holder plate, and a support plate. The holder plate has a rear side surface opposite to the front side surface and a horizontal row of interconnected abutting blocks which are fixed on the rear side surface thereof and which are different in thickness so as to define a stepped surface thereon. The support plate is attached pivotally and inclinedly to the holder plate and has a horizontally movable sliding unit thereon to contact the stepped surface in such a manner that the sliding unit abuts against a selected one of the blocks of the holder plate so as to form a predetermined angle between the holder plate and the support plate. The sliding unit can be moved on the support plate for removal from the selected one of the blocks to abut against another one of the blocks, thereby changing the angle between the holder plate and the support plate.

3 Claims, 3 Drawing Sheets

PAPER HOLDER ON WHICH A SHEET OF PAPER CAN BE SUPPORTED AT DIFFERENT INCLINATIONS

BACKGROUND OF THE INVENTION

1. Field of the Invention

The invention relates to a paper holder, more particularly to a paper holder which can support a sheet of paper at different inclinations.

2. Description of the Related Art

A conventional paper holder includes a generally rectangular holder plate and a clip member mounted on the holder plate so as to clamp a sheet of paper which lies on a side surface thereof.

In use, the aforesaid paper holder is generally held by one hand in order to permit the other hand to write thereon. However, the paper holder cannot be supported inclinedly on a desk without assistance of other articles, thereby limiting the range of use thereof.

SUMMARY OF THE INVENTION

The object of this invention is to provide a paper holder which can clamp a sheet of paper thereon and which can support the sheet of paper at different inclinations.

Accordingly, the paper holder of this invention includes a generally rectangular holder plate, a clip member mounted on the holder plate and adapted to clamp a sheet of paper which lies on a front side surface of the holder plate, and a support plate. The holder plate has a rear side surface opposite to the front side surface and a horizontal row of interconnected abutting blocks which are fixed on the rear side surface thereof and which are different in thickness so as to define a stepped surface thereon. The support plate is attached pivotally and inclinedly to the holder plate and has a horizontally movable sliding unit contacting the stepped surface in such a manner that the sliding unit abuts against a selected one of the blocks of the holder plate so as to form a predetermined angle between the holder plate and the support plate. The sliding unit can be moved on the support plate for removal from the selected one of the blocks to abut against another one of the blocks, thereby changing an angle between the holder plate and the support plate.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
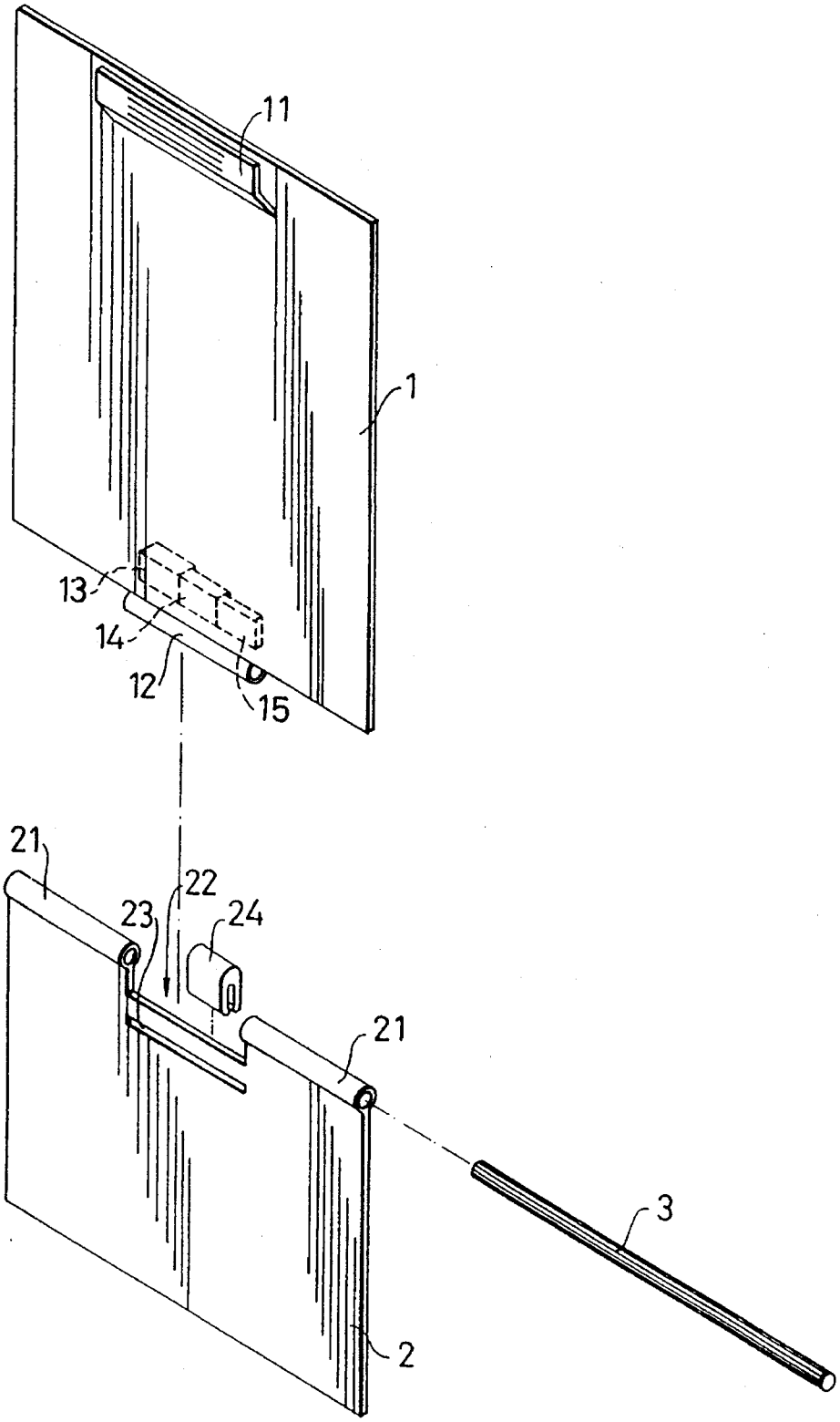
FIG. 1 is an exploded view of a paper holder of this invention.

Referring to FIG. 1, a paper holder of this invention includes a generally rectangular holder plate 1, a clip member 11, and a support plate 2.

As illustrated, the clip member 11 is mounted on a front side surface of the holder plate 1 adjacent to the upper end of the holder plate 1 so as to clamp a sheet of paper (not shown) which is placed on a front side surface thereof. The holder plate 1 has a rear side surface opposite to the front side surface, a horizontal row of interconnected abutting blocks 13, 14, 15 which are fixed on the rear side surface thereof and which are different in thickness so as to define a stepped surface thereon, and a fixed hollow tubular portion 12 located on the middle section of the bottom side portion of the holder plate 1.

The support plate 2 has a pair of aligned and spaced tubular portions 21 located on two sides of the tubular portion 12 of the holder plate 1. A pivot unit includes a pivot pin 3 which extends through the tubular portions 21 of the support plate 2 and the tubular portion 12 of the holder plate 1 so as to interconnect pivotally the holder plate 1 and the support plate 2 together. The support plate 2 is formed with a recession 22 and further has a horizontal slot 23 near the recession 22 in parallel with the tubular portions 21, and a horizontally movable sliding unit 24 which has a portion received slidably in the slot 23 and which contacts the stepped surface of the holder plate 1.

Figure 2:
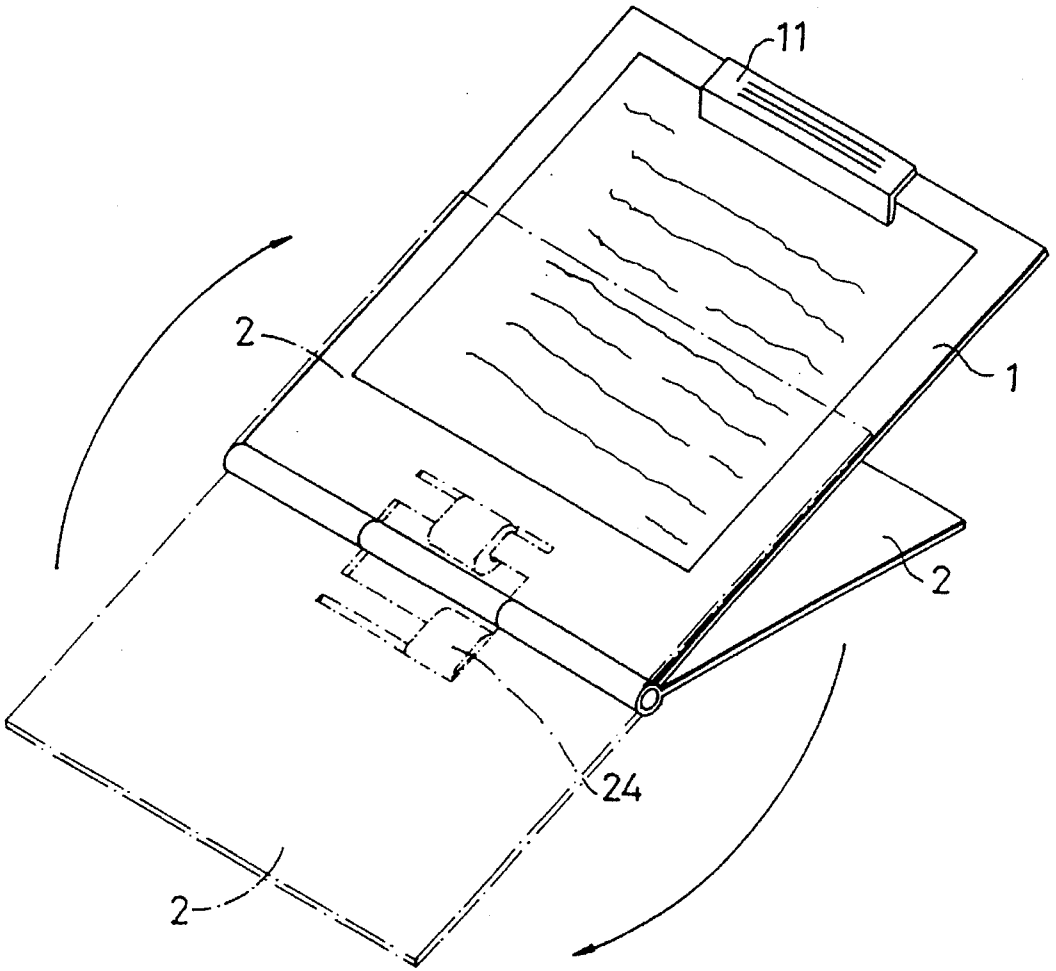
FIG. 2 illustrates the use of the paper holder of this invention.
Figure 3:
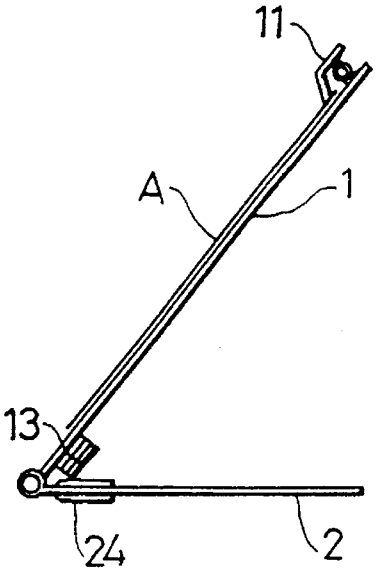
FIGS. 3, 4 and 5 illustrate how the plate of the paper holder of this invention is located at different angles.
Figure 4:
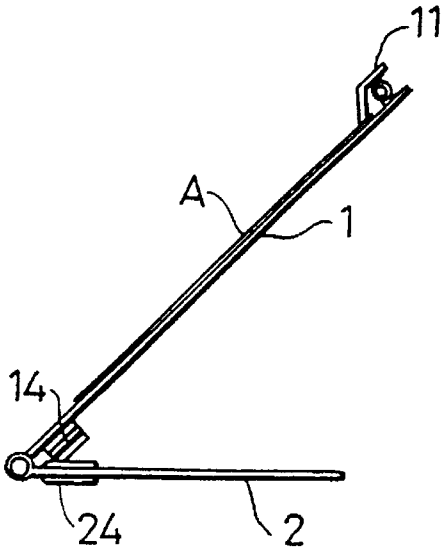
Figure 5:
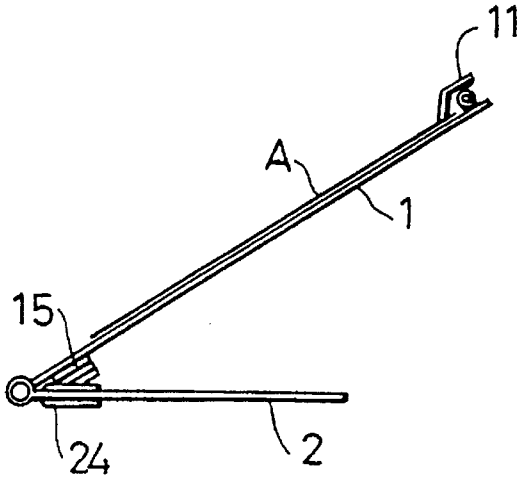

As illustrated in FIG. 2, the support plate 2 can be pivoted relative to the holder plate 1 so that the sliding unit 24 abuts against a selected one of the blocks 13, 14, 15 (see FIG. 1) of the holder plate 1, so as to form a predetermined angle between the holder plate 1 and the support plate 2. The sliding unit 24 can be moved on the support plate 2 from one of the blocks 13, 14, 15 to abut against another one of the blocks 13, 14, 15, as shown in the positions of FIGS. 4 and 5 so as to change the angle between the holder plate 1 and the support plate 2. Accordingly, as illustrated in FIGS. 3, 4 and 5, the holder plate 1 of this invention can be placed on a support surface at different inclinations so as to permit the clip member 11 to clamp a sheet of paper (A) thereon.

With the invention thus explained, it is obvious to those skilled in the art that various modifications and variations can be made without departing from the scope and spirit thereof. It is therefore intended that the invention be limited only as in the appended claims.

I claim:

1. A paper holder, comprising a generally rectangular holder plate and a clip member mounted on plate and adapted to clamp a sheet of paper which is placed on a front side surface of the holder plate;

the holder plate having a rear side surface opposite to the front side surface and a horizontal row of interconnected abutting blocks which are fixed on the rear side surface thereof and which are different in thickness so as to define a stepped surface thereon; and a support plate attached pivotally and inclinedly to the holder plate and having a horizontally movable sliding unit thereon to contact said stepped surface in such a manner that the sliding unit abuts against a selected one of the blocks of the holder plate so as to form a predetermined angle between the holder plate and the support plate, the sliding unit being movable on the support plate for removal from the selected one of the blocks to abut against another one of the blocks, thereby changing an angle between the holder plate and the support plate.

2. The paper holder as defined in claim 1, characterized in that a pivot unit interconnects the holder plate and the support plate, the holder plate having a fixed hollow tubular portion located on a middle section of a bottom side portion of the holder plate, the support plate having a pair of aligned and spaced tubular portions located on two sides of the tubular portion of the holder plate, the pivot unit including a pivot pin extending through the tubular portions of the support plate and the tubular portion of the holder plate so as to interconnect pivotally the holder plate and the support plate.

3. The paper holder as defined in claim 1, characterized in that the support plate is formed with a horizontal slot which receives slidably a portion of the sliding unit therein.

* * * * *